US008144104B2

(12) United States Patent
Matsuura

(10) Patent No.: US 8,144,104 B2
(45) Date of Patent: Mar. 27, 2012

(54) ELECTRO-OPTICAL DEVICE

(75) Inventor: Yoshiyuki Matsuura, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 335 days.

(21) Appl. No.: 12/571,670

(22) Filed: Oct. 1, 2009

(65) Prior Publication Data

US 2010/0091046 A1 Apr. 15, 2010

(30) Foreign Application Priority Data

Oct. 10, 2008 (JP) ..... 2008-264286

(51) Int. Cl.
*G09G 3/36* (2006.01)

(52) U.S. Cl. ..... 345/100; 345/204; 345/208; 345/94; 345/690; 345/88

(58) Field of Classification Search ..... 345/87–104, 345/204, 208, 210, 690
See application file for complete search history.

(56) References Cited

U.S. PATENT DOCUMENTS

2002/0015031 A1* 2/2002 Fujita et al. ..... 345/204
2003/0058229 A1* 3/2003 Kawabe et al. ..... 345/204
2004/0066361 A1* 4/2004 Ishii et al. ..... 345/87
2004/0075631 A1* 4/2004 Ishiguchi ..... 345/96
2004/0140968 A1* 7/2004 Kasai et al. ..... 345/204
2005/0035981 A1* 2/2005 Ozaki ..... 345/690
2006/0028463 A1 2/2006 Nakamura et al.
2007/0229482 A1* 10/2007 Morinaga et al. ..... 345/204

FOREIGN PATENT DOCUMENTS

JP A-2006-047847 2/2006

* cited by examiner

*Primary Examiner* — Lun-Yi Lao
*Assistant Examiner* — Sosina Abebe
(74) *Attorney, Agent, or Firm* — Oliff & Berridge, PLC

(57) ABSTRACT

A scanning line driving circuit includes: each stage shifts and outputs in sequence a start pulse; and logic circuits provided corresponding to the scanning lines and operating to determine the logical product of a signal outputted from the shift register of the stage corresponding to the scanning line and an enable signal supplied differently every group, the enable signal corresponding to the group becomes, in a horizontal scanning period in which the image data writing is carried out for the scanning lines belonging to the group, an active level in a horizontal effective scanning period and an inactive level in a horizontal return line period; and in a horizontal scanning period in which the image data writing is not carried out for the scanning lines belonging to the group, an inactive level in the horizontal effective scanning period and an active level in the horizontal return line period.

4 Claims, 11 Drawing Sheets

ELECTRO-OPTICAL DEVICE

BACKGROUND

1. Technical Field

The present invention relates to an electro-optical device in which a so-called moving picture blurring feeling is suppressed.

2. Related Art

An electro-optical device such as an active matrix type liquid crystal device is a hold type device in which an image data is maintained over a frame period (16.7 milliseconds). Therefore, when a transition to the next frame period has been done, memory of the image data from the previous frame period remains, and therefore, if movement exists in the displayed image data, the movement region is perceived awkwardly or with a contour blurred (the occurrence of a moving image data blurring feeling). Conversely, in an impulse type display device in which an image data is instantaneously displayed like a CRT, the memory of the image data displayed in the previous frame period does not remain on transition to the next frame period; hence, a moving image blurring feeling does not occur.

Accordingly, in order to make the hold type electro-optical device similar to an impulse type display, technology has been proposed in which after a display image has been written by scanning the scanning lines by a vertical shift register for image data writing, a black image data (black insertion) is written by scanning the scanning lines by a shift register for black writing (JP-A-2006-47847).

However, in the above technology, since two shift registers are required, the circuit area becomes large, so that in a case of a peripheral circuit built-in type device, there is a problem in that a so-called frame region is enlarged.

SUMMARY

An advantage of some aspects of the invention is that it provides technology in which image data writing and black insertion writing are finished by one vertical shift register, so that the enlargement of a circuit area is suppressed.

According to an aspect of the invention, there is provided an electro-optical device including: pixels respectively provided corresponding to the intersections of a plurality of scanning lines and a plurality of data lines and having gray scale according to a data signal supplied to the data line when the scanning line has been selected; a scanning line driving circuit which selects the plurality of scanning lines; and a data line driving circuit which supplies a data signal according to the gray scale of the pixel to the data line when the scanning line has been selected for image data writing, and supplies a data signal making the pixel a black color to the data line when the scanning line is selected for black insertion writing, wherein the scanning line driving circuit includes: a shift register having the number of stages according to the plurality of scanning lines, where each stage shifts and outputs in sequence a start pulse having a predetermined width in accordance with the period of a clock signal; and logic circuits provided corresponding to the scanning lines and operating to determine the logical product of a signal outputted from the shift register of the stage corresponding to the scanning line and an enable signal supplied differently every group when a given number of adjacent scanning lines have been grouped together, and then supply it as a scanning signal representing the selection of the scanning line, the enable signal corresponding to the group becomes, in a horizontal scanning period in which the image data writing is carried out for the scanning lines belonging to the group, an active level in a horizontal effective scanning period and an inactive level in a horizontal return line period; and in a horizontal scanning period in which the image data writing is not carried out for the scanning lines belonging to the group, an inactive level in the horizontal effective scanning period and an active level in the horizontal return line period, the data line driving circuit changes and supplies the voltage of the data signal into positive polarity and negative polarity every horizontal scanning period on the basis of a given electric potential, when viewed in one column of pixels sharing the data line. According to this aspect, since only one vertical shift register is required, it becomes possible to suppress the enlargement of the area of the scanning line driving circuit.

In the invention according to the aspect, a frame period may also be set to be the odd number times of the period of the clock signal and the horizontal scanning period may also be set to be the period of the clock signal. According to this aspect, since the frame period becomes the odd number times of the horizontal scanning period, when a row inversion method or a pixel inversion method was adopted, the occurrence of a portion where adjacent rows have the same polarity as each other may be avoided.

Also, in the invention according to the aspect, the data line driving circuit may also make the data signal in the image data writing the same polarity as the data signal in the black insertion writing before the image data writing.

BRIEF DESCRIPTION OF THE DRAWINGS

The invention will be described with reference to the accompanying drawings, wherein like reference numbers represent like elements.

DESCRIPTION OF EXEMPLARY EMBODIMENTS

Hereinafter, modes for carrying out the invention will be described.

First Embodiment

Figure 1:
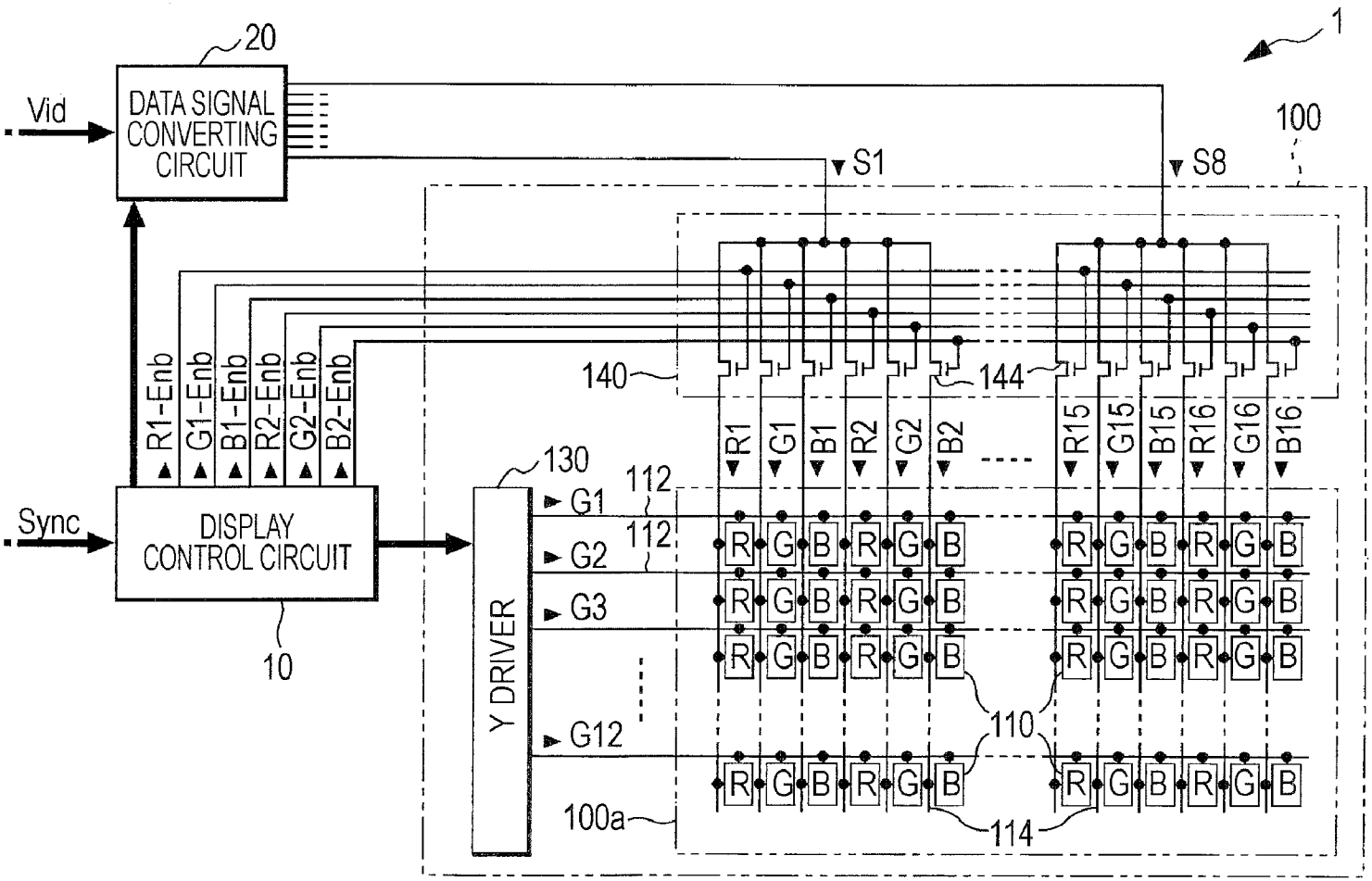
FIG. 1 is a diagram illustrating an electro-optical device to which a scanning line driving circuit according to a first embodiment has been applied.

First, a scanning line driving circuit according to the first embodiment of the invention is explained. FIG. 1 is a block diagram showing the configuration of an electro-optical device to which the scanning line driving circuit has been applied.

As shown in this drawing, the electro-optical device 1 is constituted by a display control circuit 10, a data signal converting circuit 20, and a display panel 100. Among them, the display control circuit 10 controls each part on the basis of a synchronization signal Sync supplied from a higher-level device (not shown). The data signal converting circuit 20 converts and outputs digital video signals Vid supplied from the higher-level device into analog data signals S1 to S8 in synchronization with the distribution operation of a demultiplexer, which will be described later, according to the control of the control circuit 10.

Here, the video signals Vid supplied from the higher-level device are digital data which specify the gray scale (brightness) of each color component of R (red), G (green), and B (blue) for each pixel of the display panel 100, and are supplied in order of the pixels scanned in accordance with a vertical scanning signal, a horizontal scanning signal, and a dot clock signal (all not shown), which are included in the synchronization signal Sync.

In the display panel 100, a Y driver 130 and the demultiplexer 140 are provided on the periphery of a display region 100*a*. In the display region 100*a*, for example, 12 rows of scanning lines 112 extend in a transverse direction in the drawing, and 48 columns of data lines 114 extend in a longitudinal direction in the drawing. In addition, each pixel 110 is provided to maintain electrical insulation between it and each scanning line 112 and arranged corresponding to each intersection of the scanning lines 112 and the data lines 114.

These pixels 110 are arranged in a stripe array in which the pixels are repeated in order of R, G, and B for each column, and the color of 1 dot is displayed by three pixels 110 of RGB which are adjacent to each other in a transverse direction. Accordingly, in this embodiment, the pixels 110 are arranged in a matrix form of 12 rows vertically×48 columns horizontally in the display region 100*a*, so that the color display of the dots of 12 rows vertically×16 columns horizontally is carried out. However, this array is only for convenience in the explanation and the invention is not to be construed as being limited to this array.

Also, in the following explanation, in order to distinguish the scanning lines 112, there is a case where they are called the 1st, the 2nd, the 3rd, . . . , and the 12th rows in order of the above in the drawing. Similarly, in order to distinguish the data lines 114, there is a case where they are called the 1st, the 2nd, the 3rd, . . . , and the 48th columns in order from the left in the drawing.

The Y driver (scanning line driving circuit) 130, which is a characterizing portion of the invention, supplies a scanning signal to each scanning line according to the control by the display control circuit 10. However, the details thereof will be described later.

Further, the data lines 114 of the 1st to 48th columns are blocked for every adjacent 6 columns in this embodiment; like the 1st to 6th, the 7th to 12th, the 13th to 18th, . . . , and the 43rd to 48th columns. If integer "j" of 1 or more and 8 or less is used in order to generalize and explain the blocks, 6 columns of data lines 114 from the (6*j*-5)th column to the (6*j*)th column correspond to the j-th block counting from left in FIG. 1.

Although the data signals S1 to S8 are supplied in sequence to the 1st to 8th blocks, in order to distinguish the data signals distributed to 6 columns of data lines belonging to each block, in the j-th block, the data signal supplied to the data line 114 of the 1st column is denoted by R(2*j*-1), and the data signals supplied to the data lines 114 of the 2nd, 3rd, 4th, 5th, and 6th columns are denoted by G(2*j*-1), B(2*j*-1), R(2*j*), G(2*j*), and B(2*j*), respectively.

The demultiplexer (data line driving circuit) 140 is an aggregation of n-channel type thin film transistors (hereinafter, a thin film transistor is abbreviated to a "TFT") 144, each of which is provided for every one column of the data line 114. The drain electrode of the TFT 144 is connected to one end of the data line 114, and the source electrodes of 6 TFTs 144 corresponding to the data lines 114 which belong to each block are connected in common.

On the other hand, a control signal as described below is supplied to the gate electrode of each TFT 144 from the display control circuit 10. That is, to the gate electrode of the TFT 144 corresponding to the data line 114 of the 1st column in each block, an enable signal R1-Enb is supplied, and to the gate electrodes of the TFTs 144 corresponding to the data lines 114 of the 1st, 2nd, 3rd, 4th, 5th, and 6th columns in each block, enable signals G1-Enb, B1-Enb, R2-Enb, G2-Enb, and B2-Enb are supplied respectively.

Figure 2:
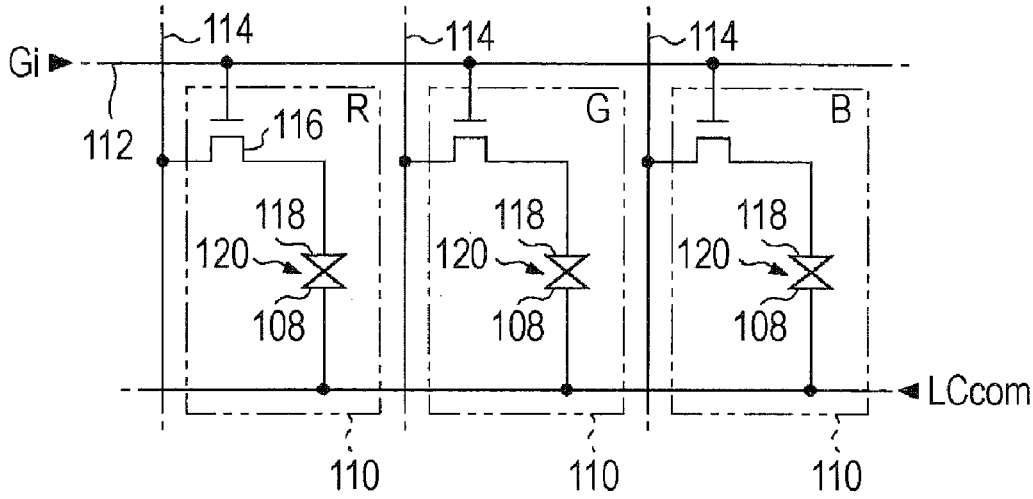
FIG. 2 is a diagram illustrating the configuration of a pixel in the electro-optical device.

Next, the configuration of the pixel 110 is explained. FIG. 2 is a diagram showing the electrical configuration of the pixel 110 and shows three pixels 110 of RGB in arbitrary one row.

As shown in the drawing, three pixels 110 have electrically the same configuration as each other and each includes a TFT 116 and a liquid crystal capacity 120. Here, the gate electrode of the TFT 116 is connected to the scanning line 112, the source electrode of the TFT is connected to the data line 114, and the drain electrode of the TFT is connected to a pixel electrode 118.

The pixel electrode 118 is provided for each pixel, whereas a counter electrode 108 is provided in common for all pixels so as to face all of the pixel electrodes 118 and a constant voltage LCcom is applied thereto. Further, a liquid crystal 105 is interposed between the counter electrode 108 and the pixel electrode 118, thereby configuring the liquid crystal capacity 120.

In this embodiment, the liquid crystal 105 is in a OCB (Optical Compensated Birefringence) mode. Therefore, the liquid crystal molecules are, in the initial state, in a state (spray orientation) in which they are opened in a spray pattern between two substrates, and become, in the display operation, a state (bend orientation) in which they are arched, and thus a transmittance (or reflectance) varies with the bending extent of the bend orientation. In this embodiment, a normally-white mode is adopted in which the transmittance of light is maximized if the effective value of a voltage held in the liquid crystal capacity 120 is close to zero, and on the other hand, the amount of transmitted light is decreased with the increase of the effective voltage value. Further, a color filter (not shown) which colors the transmitted light of the liquid crystal capacity 120 is provided for each pixel 110. Therefore, the light illuminated by a backlight unit (not shown) is colored and outputted by the color filter at a rate according to the effective value of the voltage held in the liquid crystal capacity 120 for each pixel.

As is well known, in the OCB mode, if the effective value of the voltage held in the liquid crystal capacity 120 falls below a critical level, the liquid crystal molecules are returned to the spray orientation, so that it does not become possible to control a transmittance in accordance with the effective value. Therefore, it is necessary to transfer it into the bend orientation by applying a voltage of the critical level or more before the writing of the voltage, according to the gray scale of an image data to be displayed.

In this embodiment, the returning to the spray orientation is prevented by writing the voltage according to the gray scale of a display image data to the liquid crystal capacity 120 (pixel 110) in a certain frame period, and thereafter writing a voltage of the critical level or more as advance preparation for writing the voltage according to a transmittance in the subsequent frame period.

At this time, as the voltage of the critical level or more, which is written in order to prevent the returning to the spray orientation, a voltage minimizing the transmittance of the pixel 110 is used. That is, in this embodiment, the application of the voltage of the critical level or more for maintaining the bend orientation to prevent the returning to the spray orientation also means black insertion for reducing the blurring feeling of a moving picture.

Also, the frame period is referred to as a period required to display 1 coma of a color image by driving the display panel 100, and, if a vertical scanning frequency is 60 Hz, it is 16.7 milliseconds which is the reciprocal thereof, and stays constant.

Figure 3:
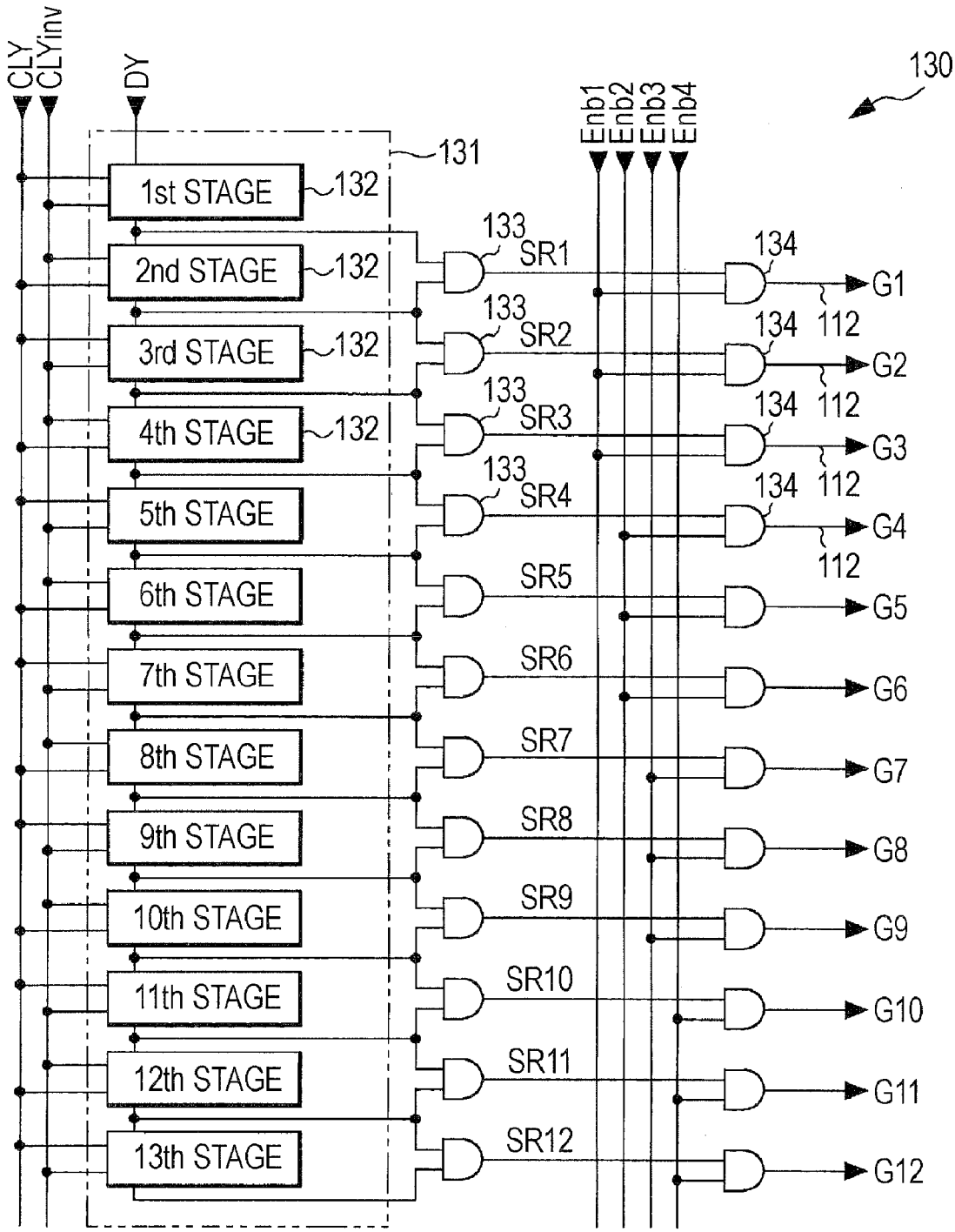
FIG. 3 is a diagram illustrating the configuration of the scanning line driving circuit.

Subsequently, the Y driver 130, which is a characterizing portion of the invention, is explained. FIG. 3 is a diagram showing the configuration of the Y driver 130.

Figure 5:
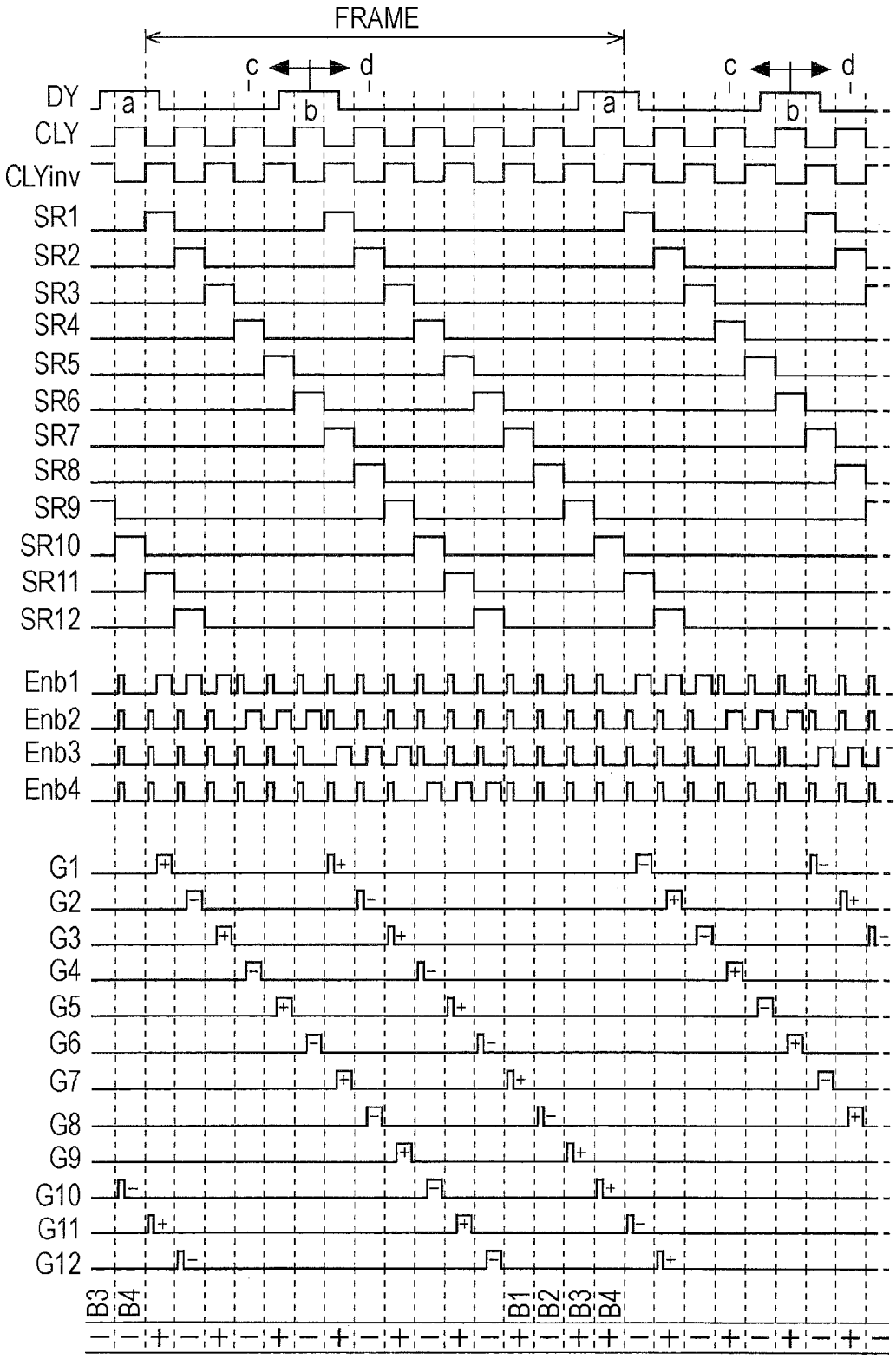
FIG. 5 is a diagram illustrating the operation of the scanning line driving circuit.

As shown in the drawing, clock signals CLY and CLYinv, a start pulse DY, and enable signals Enb1 to Enb4 are supplied to the Y driver 130 from the display control circuit 10. Among them, the clock signals CLY and CLYinv are pulse signals having a duty ratio of 50%, in which logic levels are in the inversion relationship with each other, as shown in FIG. 5, and are generated such that the half period of each signal becomes a horizontal scanning period which is defined by a horizontal synchronization signal supplied from the higher-level device.

Here, the horizontal scanning period is divided into a horizontal effective scanning period which horizontally scans the pixels in one row from the 1st column to the 48th column, and a horizontal return line period which returns from the 48th column to the 1st column in the next row. In this embodiment, for convenience sake, the horizontal return line period is performed first, and the horizontal effective scanning period is performed thereafter.

In FIG. 3, a shift register 131 has a configuration in which unit circuits 132 of "13" stages, which is 1 stage more than "12" that is the number of rows of the scanning lines 112, are cascade-connected such that a signal outputted from the unit circuit 132 of a certain stage becomes an input signal of the unit circuit of the subsequent stage. However, to the unit circuit 132 of the 1st stage which is the initial stage, the start pulse DY is supplied as an input signal.

In the shift register 131, the unit circuits 132 of the odd numbered (1st, 3rd, 5th, . . . , and 13th) stages receive and output an input signal when the clock signal CLY is in a H level (the clock signal CLYinv is in an L level); and when the clock signal CLY has been changed to an L level (the clock signal CLYinv has been changed to a H level), hold and output the input signal which was received in a state just before the change (when the clock signal CLY was in a H level).

On the other hand, the unit circuits 132 of the even numbered (2nd, 4th, 6th, . . . , and 12th) stages receive and output an input signal when the clock signal CLY is in an L level; and when the clock signal CLY has been changed to a H level, hold and output the input signal which was received in a state just before the change.

Figure 4:
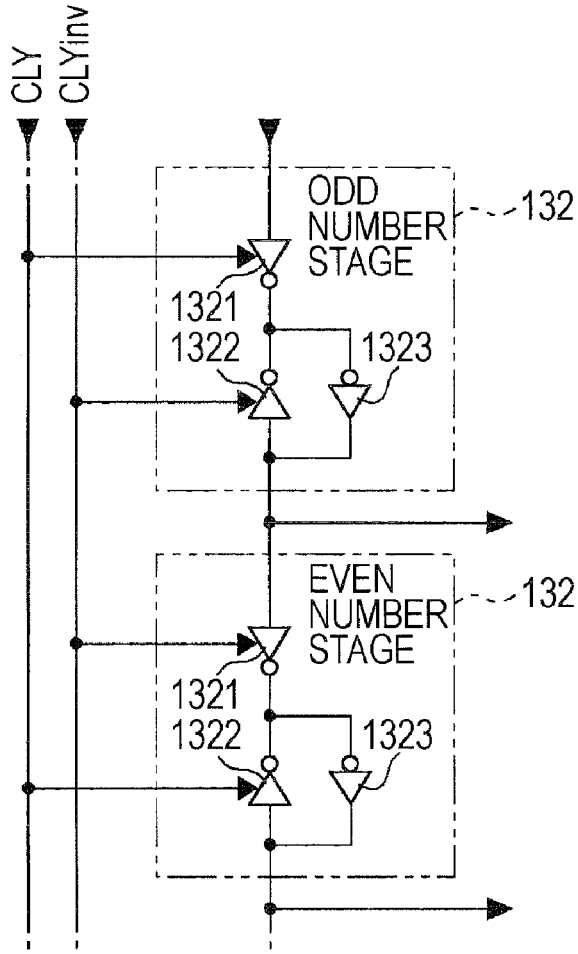
FIG. 4 is a diagram illustrating an example of the configuration of a unit circuit in the scanning line driving circuit.

The unit circuits 132 of the odd numbered and even numbered stages may have a configuration in which each unit circuit includes clocked inverters 1321 and 1322 and an inverter 1323, for example, as shown in FIG. 4.

The clocked inverter 1321 of the odd numbered stage and the clocked inverter 1322 of the even numbered stage function as inverters when the clock signal CLY is in a H level, and their outputs become indefiniteness (high impedance) when the clock signal CLY is in an L level; and the clocked inverter 1322 of the odd numbered stage and the clocked inverter 1321 of the even numbered stage function as inverters when the clock signal CLYinv is in a H level, and their outputs become indefiniteness when the clock signal CLYinv is in an L level.

Here, for convenience sake, integer "i" of 1 or more and 12 or less is used in order to generalize and explain the scanning lines 112.

AND circuits 133 are provided corresponding to the scanning lines 112 of the 1st to the 12th rows. The AND circuit of the 1st row determines the logical product of a signal outputted from the unit circuit 132 of a self-stage, the i-th stage, and a signal outputted from the unit circuit 132 of the next (i+1)th stage and outputs it as a signal SRi.

Each of the AND circuits 134 of the 1st to the 12th rows outputs the logical product signal of the logical product signal determined by the AND circuit 133 and the enable signal to the scanning line 112 as a scanning signal. Here, the enable signals supplied to the AND circuits 134 are the enable signal Enb1 with respect to the 1st to the 3rd rows; the enable signal Enb2 with respect to the 4th to the 6th rows; the enable signal Enb3 with respect to the 7th to the 9th rows; and the enable signal Enb4 with respect to the 10th to the 12th rows.

Namely, in this embodiment, the scanning lines 112 are grouped for every three rows like the 1st to 3rd rows, the 4th to 6th rows, the 7th to 9th rows, and the 10th to 12th rows, and to each group, the different enable signals Enb1 to Enb4 are supplied in sequence.

Further, with respect to the enable signals Enb1 to Enb4, the display control circuit 10 outputs them as shown in FIG. 5.

Next, the operation of the Y driver 130 is explained with reference to FIG. 5. In this drawing, if the start pulse DY having a pulse width corresponding to 1 period of the clock signal CLY (CLYinv), as denoted by "a", is supplied prior to the timing at which the clock signal CLY becomes a H level, the unit circuit 132 of the 1st stage receives the start pulse DY in the H level period of the clock signal CLY, and then holds the received signal when the clock signal CLY is in an L level.

The unit circuit 132 of the 2nd stage receives the output signal from the unit circuit 132 of the 1st stage in the L level period of the clock signal CLY, and then holds the received signal when the clock signal CLY is in a H level. After this, such an operation is carried out in order also in the subsequent stages, the 3rd, 4th, . . . , and 13th stages.

Therefore, the signals having the start pulses DY denoted by "a", which delayed in sequence only the half period of the clock signal CLY from the state in which they were received when the clock signal CLY was in a H level are outputted from the unit circuits 132 of the 1st to 13th stages. With respect to the signals outputted from the AND circuits 133 of the 1st to 12th rows, since the overlap portion of the signals of adjacent rows among the pulse signals that are half-period delayed in sequence is outputted, the signals SR1 to SR12 have waveforms of the pulses having a half-period width of the clock signal CLY which are delayed in sequence by half period of the clock signal CLY, as shown in FIG. 5.

Further, in this embodiment, due to the start pulses DY denoted by "a", during that the signals SR1 to SR12 become H levels with delayed in sequence by only the half period of the clock signal CLY, the start pulse DY denoted by "b" is supplied. Specifically, the start pulse DY denoted by "b" is supplied with delayed by only 6 horizontal scanning periods (3 periods of the clock signal CLY) corresponding to the half of 12 which is the number of scanning lines, with respect to the start pulses DY denoted by "a".

Accordingly, by the transmission of the start pulses DY denoted by "a", the signals SR1 to SR12 undergo a change to a H level with delayed in sequence. However, even when 6 horizontal scanning periods have passed, by the transmission of the start pulses DY denoted by "b", the signals SR1 to SR12 become H levels in sequence again. Therefore, there is a case where two signals of the signals SR1 to SR12 simultaneously become H levels.

Here, for example, focusing on the i-th row, that the signal SRi from the AND circuit 133 of the self-stage and the i-th row becomes a H level means that it is a period in which the scanning line 112 of the i-th row should be selected for the writing (image data writing) of the voltage according to the gray scale of the display image data, or for the writing (black insertion writing) of a voltage making the pixel a black color.

Also, a time when the signals SR1 to SR12 have become H levels due to the start pulses DY denoted by "a" means that the scanning line should be selected for the image data writing, and a time when the signals SR1 to SR12 have become H levels due to the start pulses DY denoted by "b" means that the scanning line should be selected for the black insertion writing.

In order to separate selection in the image data writing and selection in the black insertion writing, the display control circuit 10 outputs the enable signals Enb1 to Enb4 as described below.

That is, the enable signal Enb1 is a pulse signal which becomes a H level only in each horizontal effective scanning period of three horizontal scanning periods where the signals SR1 to SR3 become H levels in sequence due to the start pulse DY denoted by "a", and becomes a H level only in each horizontal return line period in the other horizontal scanning periods. Next, the enable signal Enb2 is a pulse signal which becomes a H level only in each horizontal effective scanning period of three horizontal scanning periods where the signals SR4 to SR6 become H levels in sequence due to the start pulse DY denoted by "a", and becomes a H level only in each horizontal return line period in the other horizontal scanning periods. Subsequently, the enable signal Enb3 is a pulse signal which becomes a H level only in each horizontal effective scanning period of three horizontal scanning periods where the signals SR7 to SR9 become a H level in sequence due to the start pulse DY denoted by "a", and becomes a H level only in each horizontal return line period in the other horizontal scanning periods. Then, the enable signal Enb4 is a pulse signal which becomes a H level only in each horizontal effective scanning period of three horizontal scanning periods where the signals SR10 to SR12 become a H level in sequence due to the start pulse DY denoted by "a", and becomes a H level only in each horizontal return line period in the other horizontal scanning periods.

Further, in this embodiment, an active level is set to be a H level and an inactive level is set to be an L level.

Since each of the scanning signals G1 to G3 is represented by the logical product of each of the signals SR1 to SR3 and the enable signal Enb1, it has a waveform as shown in FIG. 5.

Similarly, each of the scanning signals G4 to GE is represented by the logical product of each of the signals SR4 to SR6 and the enable signal Enb2, each of the scanning signals G7 to G9 is represented by the logical product of each of the signals SR7 to SR9 and the enable signal Enb3, and each of the scanning signals G10 to G12 is represented by the logical product of each of the signals SR10 to SR12 and the enable signal Enb4. Therefore these signals have waveforms as shown in FIG. 5.

That is, in the scanning signals G1 to G12, the pulses long in width for the image data writing, namely, the pulses becoming a H level in the horizontal effective scanning period appear in sequence due to the start pulses DY denoted by "a" having been shifted in sequence, and also, the pulses short in width for the black insertion writing, namely, the pulses becoming a H level in the horizontal return line period appear in sequence without overlap due to the start pulses DY denoted by "b" having been shifted in sequence.

Figure 6:
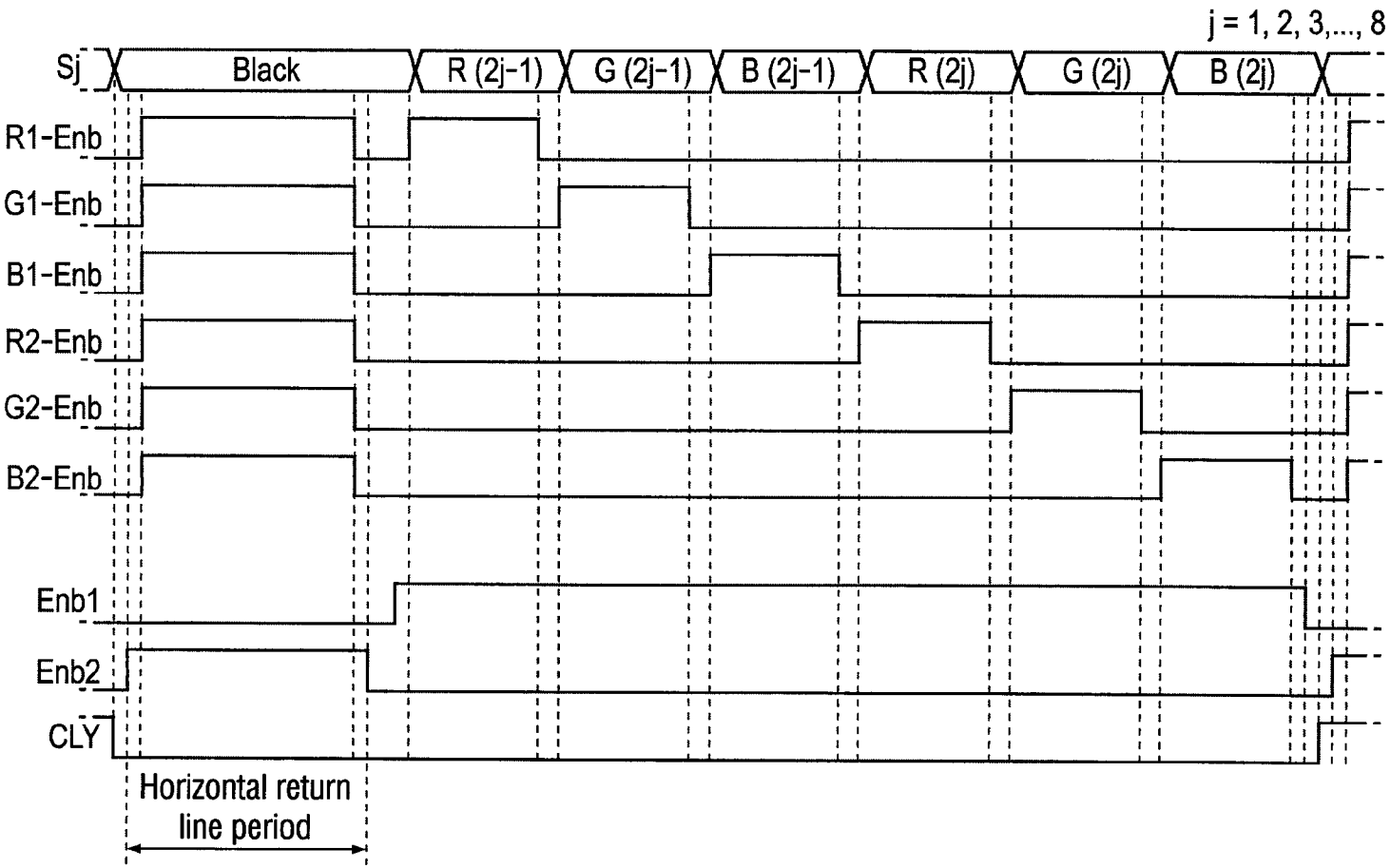
FIG. 6 is a diagram illustrating the horizontal scanning operation of the electro-optical device.

Next, an operation in the horizontal scanning period is explained with reference to FIG. 6. FIG. 6 is a diagram showing the supply timing of the data signal Sj, etc., which is supplied corresponding to the j-th block, in the horizontal scanning period.

The data signal converting circuit 20 supplies, in the horizontal return line period which is prior to the horizontal scanning period in terms of time, the data signal Sj having the voltage (Black) making the pixel 110 the lowest gray scale, namely, minimizing a transmittance, irrespective of the video signal Vid.

On the other hand, the display control circuit 10 makes the enable signal Enb2 a H level, and at the same time, all of the enable signals R1-Enb, G1-Enb, B1-Enb, R2-Enb, G2-Enb, and B2-Enb, which are supplied to the demultiplexer 140, a H level, in the horizontal return line period.

Therefore, in the horizontal return line period, all TFTs 144 are turned on, so that the data signal of the voltage (Black) minimizing a transmittance is supplied to all data lines 114.

Since the enable signal Enb2 is in a H level, if the 11th row is designated for the black insertion writing, the scanning signal G11 becomes a H level pulse having a short width. If the scanning signal G11 is in a H level, all TFTs 116 of the 11th row are turned on, so that the voltage minimizing a transmittance is applied to the pixel electrode 118 via the data line 114 and the TFT 116. Accordingly, the pixels of the 11th row are changed from the previous voltage according to a gray scale to the voltage minimizing a transmittance, thereby performing a black display.

Next, the data signal converting circuit 20 supplies in sequence the data signals of the voltage according to a gray scale to six pixels 110, which are in the row concerned with the image data writing and correspond to the intersections of the scanning line and the data lines in each block, according to the control of the display control circuit 10, in the horizontal effective scanning period posterior to the horizontal scanning period in terms of time. Specifically, when the scanning line concerned with the image data writing is the i-th row, the data signal converting circuit 20 makes the data signal Sj corresponding to the j-th block the voltage according to the gray scale of, in sequence, the R pixel of the dot on the i-th row and the (2*j*-1)th column, the G pixel of the dot on the th row and the (2*j*-1)th column, the B pixel of the dot on the i-th row and the (2*j*-1)th column, the R pixel of the dot on the i-th row and the (2*j*)th column, the G pixel of the dot on the i-th row and the (2*j*)th column, and the B pixel of the dot on the i-th row and the (2*j*)th column.

Here, although the explanation made is typified by the j-th block, such operation is performed simultaneously and in parallel in all of the 1st to 8th blocks.

On the other hand, the display control circuit 10 makes, in the horizontal effective scanning period, the enable signal Enb1 a H level, and also, the enable signals R1-Enb, G1-Enb, B1-Enb, R2-Enb, G2-Enb, and B2-Enb a H level in sequence and exclusively in accordance with the supply of the data signals by the data signal converting circuit 20.

Therefore, in the j-th block, the data signals having the voltages according to the gray scale of the RGBRGB pixels are supplied to 6 columns of data lines, respectively.

Since the enable signal Enb1 is in a H level, if the 1st row has been designated for the image data writing, the scanning signal G1 becomes a H level pulse having a long width. If the scanning signal G1 is in a H level, all TFTs 116 of the 1st row are turned on, so that the voltage according to a gray scale is applied to the pixel electrode 118 via the data line 114 and the TFT 116. Therefore, the pixels of the 1st row are changed from the previous black state to a state having the transmittance according to a gray scale, thereby becoming visible.

In the horizontal scanning period subsequent to the horizontal scanning period in which the 11th row has been designated for the black insertion writing and the 1st row has been designated for the image data writing, the 12th row is designated for the black insertion writing and the 2nd row is designated for the image data writing. Therefore, the pixels of the 12th row are changed from the previous voltage according to a gray scale to the voltage minimizing a transmittance, thereby performing a black display, and the pixels of the 2nd row are changed from the previous black display to the state having the transmittance according to a gray scale, by the image data writing.

In the subsequent four horizontal scanning periods, the 3rd, 4th, 5th, and 6th rows are designated in sequence for the image data writing, so that the pixels are changed from the previous black display to the state having the transmittance according to a gray scale. In addition, in the four horizontal scanning periods, only the designation for the image data writing is done and the other rows are not designated for the black insertion writing.

In the subsequent six horizontal scanning periods, the combination of the rows which are designated in sequence for the black insertion writing and the image data writing undergoes a transition to the 1st·7th rows, the 2nd·8th rows, the 3rd·9th rows, the 4th·10th row, the 5th·11th rows, and the 6th·12th rows, and in the subsequent four horizontal scanning periods, the 7th, 8th, 9th, and 10th rows are designated in sequence for the black insertion writing. In addition, in the four horizontal scanning periods, only the designation for the black insertion writing is done and the other rows are not designated for the image data writing.

As a result, the image data writing and the black insertion writing are alternately carried out when looking at the same scanning line, and both the image data writing and the black insertion writing are carried out in sequence from the 1st row to the 12th row. Therefore, the row to which the voltage providing a black color is written by the black insertion writing is changed from top to bottom spaced by a certain row number, with respect to the row to which the voltage according to a gray scale is written by the image data writing.

Accordingly, since the pixel 110 having the transmittance according to a gray scale by the image data writing becomes the lowest gray scale by the black insertion writing, display in the pixel is changed from a hold type to a false impulse type, so that the blurring feeling of a moving picture is reduced, and also a bend orientation is maintained, so that display disorder due to the transference to a spray orientation can also be prevented.

Further, in this embodiment, if the start pulse DY denoted by "b" is outputted earlier in terms of the timing denoted by "c", the black insertion period is lengthened, so that an impulsive response becomes strong, whereby the blurring feeling of a moving picture can be further reduced. Also, if the start pulse DY denoted by "b" is outputted later in terms of the timing denoted by "d", the black insertion period is shortened, so that the entire screen can become bright.

In this manner, according to this embodiment, since the Y driver 130 uses only one shift register 131 so as to carry out the image data writing which writes the voltage according to the gray scale of the display image to the pixel and the black insertion writing which writes the voltage providing a black color to the pixel, it becomes possible to suppress the enlargement of a circuit area.

Second Embodiment

In principle, the liquid crystal capacity 120 adopts alternating current driving in order to prevent degray scale of the liquid crystal.

Regarding how to set writing polarity over the frame period with respect to each liquid crystal capacity 120, there are a surface (frame) inversion method which makes all pixels have the same polarity, a row (line) inversion method which inverts writing polarity for each scanning line, a column inversion method which inverts writing polarity for each data line, a pixel inversion method which inverts writing polarity for each pixel over the row and column directions, and the like, and in all methods, writing polarity is inverted with a given period (usually a frame period).

Here, writing polarity is referred to as positive polarity in a case of making the electric potential of the pixel electrode 118 a higher level than that of the counter electrode 108 in the liquid crystal capacity 120, and negative polarity in a case of making the electric potential of the pixel electrode 118 a lower level than that of the counter electrode 108. Further, the electric potential of the counter electrode 108 is not the standard of the writing polarity, but there is also a case where a so-called video amplitude center is given as the standard.

From the viewpoint of making a flicker invisible, it is considered that three methods except for the surface inversion method are advantageous; the pixel inversion method is most superior, and subsequently, the row inversion method and the column inversion method are excellent at almost the same level.

Here, in the first embodiment described above, when the row inversion method was applied, as shown in FIG. 5, the even number rows become the negative polarity (−) when the odd number rows are provided with the positive polarity (+); and in the next frame period, it is necessary that the inversion is conducted, so that the even number rows become the positive polarity (+) when the odd number rows are provided with the negative polarity (−).

At this time, if the writing polarity of two rows selected for the image data writing and the black insertion writing in the same horizontal scanning period is different polarity, the polarity of the data signals supplied to the data lines is inverted in a short period of time, and therefore, when capacity components which are parasitic on the data lines are large, a correct voltage cannot be supplied to the data lines. Therefore, the writing polarity of two rows selected for the image data writing and the black insertion writing in the same horizontal scanning period are set to have the same polarity. For example, when the first row is selected for the image data writing, the 11th row is also selected for the black insertion writing. At this time, the first row and the 11th row are set to have the same polarity.

However, such a setting causes the following problem. That is, when the writing polarity is inverted for each row of every horizontal scanning period in a certain frame period, it is necessary to invert the writing polarity in the subsequent frame period. However, at this time, if the frame period is the even number times of the horizontal scanning period, a portion appears in which adjacent horizontal scanning periods have the same polarity as each other.

In the example of FIG. 5, a vertical return line period after the last 12th row is selected for the image data writing in a certain frame period and until the 1st row is selected for the image data writing in the subsequent frame period, corresponds to four horizontal scanning periods as denoted by B1 to B4 in the Y driver 130 shown in FIG. 3. However, since B4 is inverted in preparation for the first horizontal scanning period of the subsequent frame period, the same polarity is given in B3 and B4. Therefore, the writing polarity of the black insertion writing becomes the same polarity in the 9th and 10th rows.

If the writing polarity of the black insertion writing is the same polarity in adjacent rows, the polarity of the image data writing becomes different polarity, and therefore, even in a case where the pixels should be controlled to the same transmittance, the writing amount varies. Therefore, lack of writing occurs in one of the adjacent two rows, so that a disadvantage may probably occur that it is visible as a boundary in display.

Further, here, although the row inversion method is explained taken as an example, also in the pixel inversion method, the same disadvantage occurs because the pixels on the odd number row and the even number column and on the even number row and the odd number column have negative polarity when the pixels on the odd number row and the odd number column and on the even number row and the even number column have positive polarity.

Here, the frame period becomes the even number times of the horizontal scanning period is caused, in the shift register 131 shown in FIG. 3, by two points of, first, a point (the first point) in which the unit circuits 132 of the odd numbered stages receive an input signal when the clock signal CLY is in a H level, and the unit circuits 132 of the even numbered stages receive an input signal when the clock signal CLY is in an L level, and therefore the supply interval (frame period) of the start pulse DY denoted by "a" becomes the integral number times of the period of the clock signal CLY, and, second, a point (the second point) in which the amount of delay of an input signal is the half period of the clock signal CLY and the pulse overlapping period of the self-stage and the subsequent stage is obtained and used as the horizontal scanning period.

Since the horizontal scanning period corresponds to the half period of the clock signal CLY due to these two points, the frame period which is the integral number times of the clock signal necessarily becomes the even number times of the horizontal scanning period.

Figure 7:
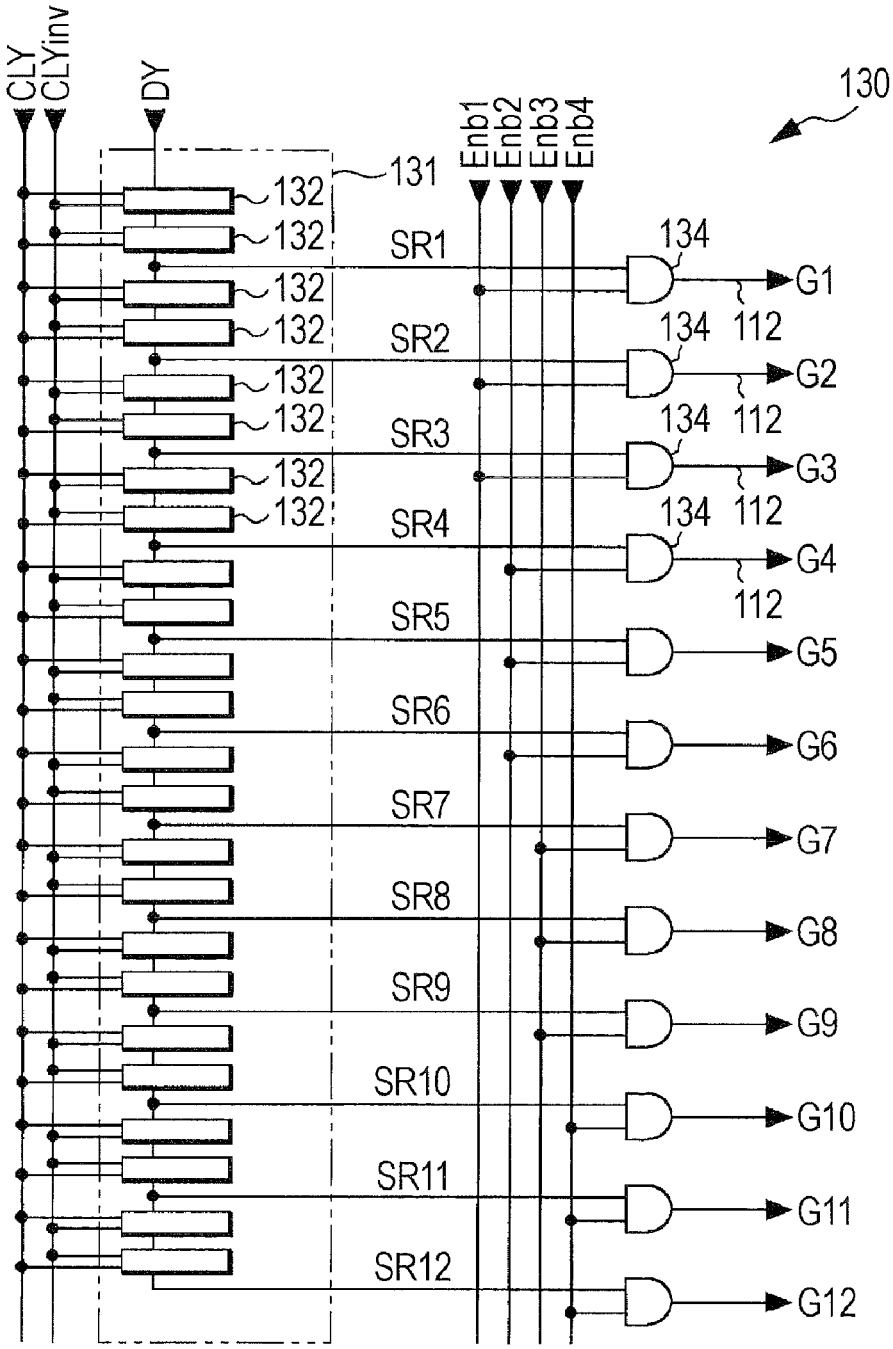
FIG. 7 is a diagram illustrating the configuration of a scanning line driving circuit according to a second embodiment.

The Y driver according to the second embodiment, which solves the above-mentioned disadvantages by making the frame period the odd number times of the horizontal scanning period in view of the above, will be explained. FIG. 7 is a block diagram showing the configuration of the Y driver 130 according to the second embodiment.

As shown in the drawing, the shift register 131 has a configuration in which unit circuits 132 of "24" stages which are twice "12" that is the row number of the scanning lines 112 are cascade-connected and one row is constituted of the unit circuits 132 of two stages of the odd number and even number stages in FIG. 3. Therefore, the two stages may also be considered as being one stage for one row of the scanning line.

In the shift register 131, since the amount of delay of the input signal corresponds to one period which is twice the half period of the clock signal CLY, the overlapping portion of the self-stage and the subsequent stage does not need to be obtained, and also the horizontal scanning period corresponds to one period of the clock signal CLY.

Figure 8:
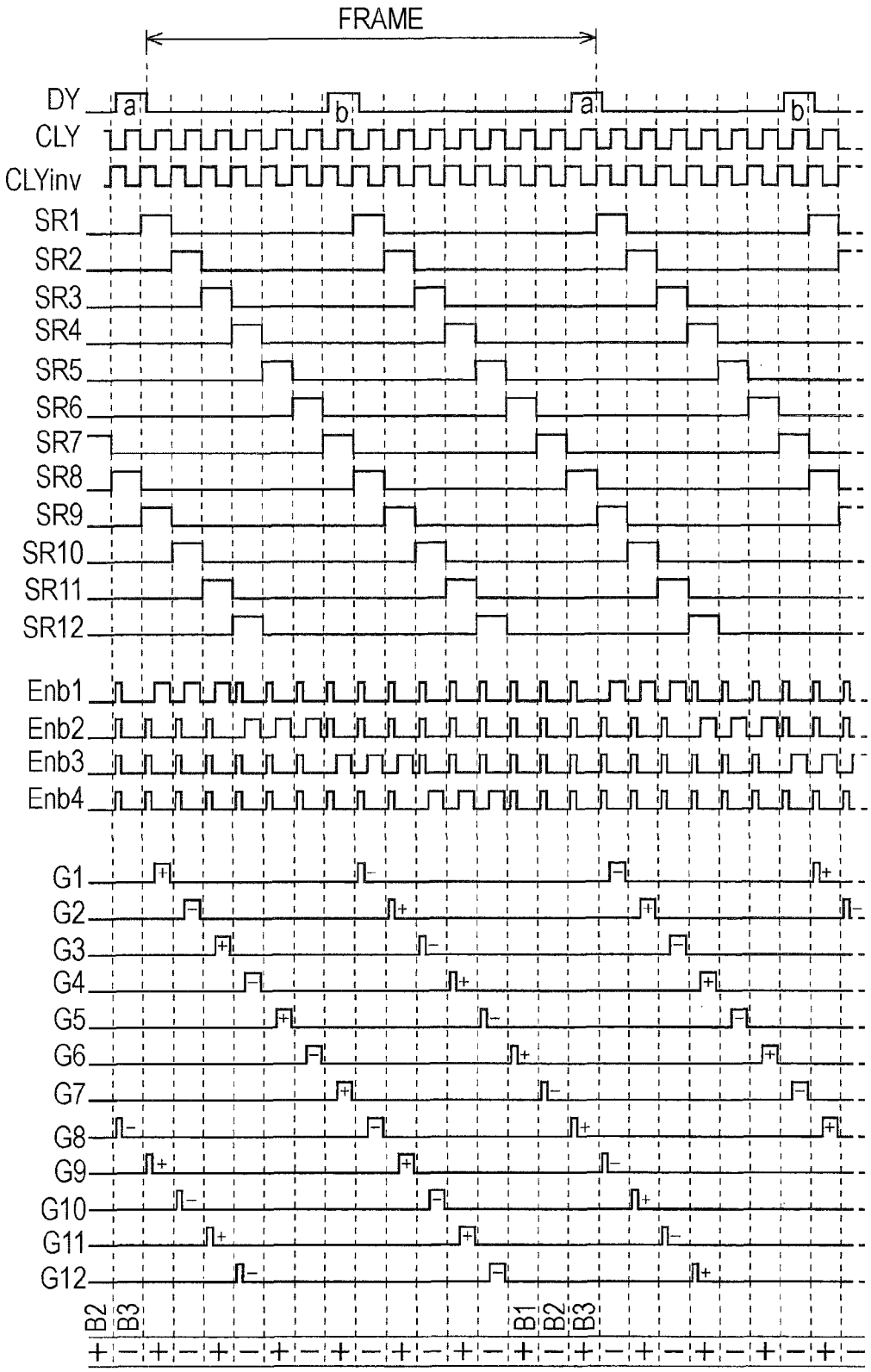
FIG. 8 is a diagram illustrating the operation of the scanning line driving circuit.

In the shift register 131 shown in FIG. 7, with respect to the first point, it is not different from the example of FIG. 3. However, since the horizontal scanning period corresponds to one period of the clock signal CLY, as shown in FIG. 8, the frame period can be set to be the odd number times of the clock signal CLY. With such setting, the frame period corresponds to the odd number times of the horizontal scanning period, so that the above-mentioned disadvantages can be solved.

Further, in the second embodiment, if the start pulse DY for black insertion denoted by "b" is delayed by the odd number times of the period of the clock signal CLY with respect to the start pulse DY for display denoted by "a", it is possible to make the writing polarity of the black insertion writing in a certain frame period the same as the polarity of the image data writing in the subsequent frame period.

Therefore, the writing of the voltage providing a black color to the pixel also becomes a pre-charge for the writing of the voltage according to a gray scale, and therefore the image data writing is expedited, and also the equal writing in which the initial state in each pixel is uniform becomes possible.

Further, in the second embodiment, if the signals outputted from the unit circuits 132 of two stages become simultaneously a H level in the rows belonging to the same group, they cannot be divided by the enable signal, and therefore, with respect to the start pulse DY denoted by "b", it is necessary to supply it in the delay range of 3 periods or more and 12 periods or less of the clock signal CLY (before 3 periods of the next start pulse DY denoted by "a") with respect to the start pulse DY denoted by "a". However, with this range, the black insertion period can be freely set.

Application and Modification Example

Figure 9:
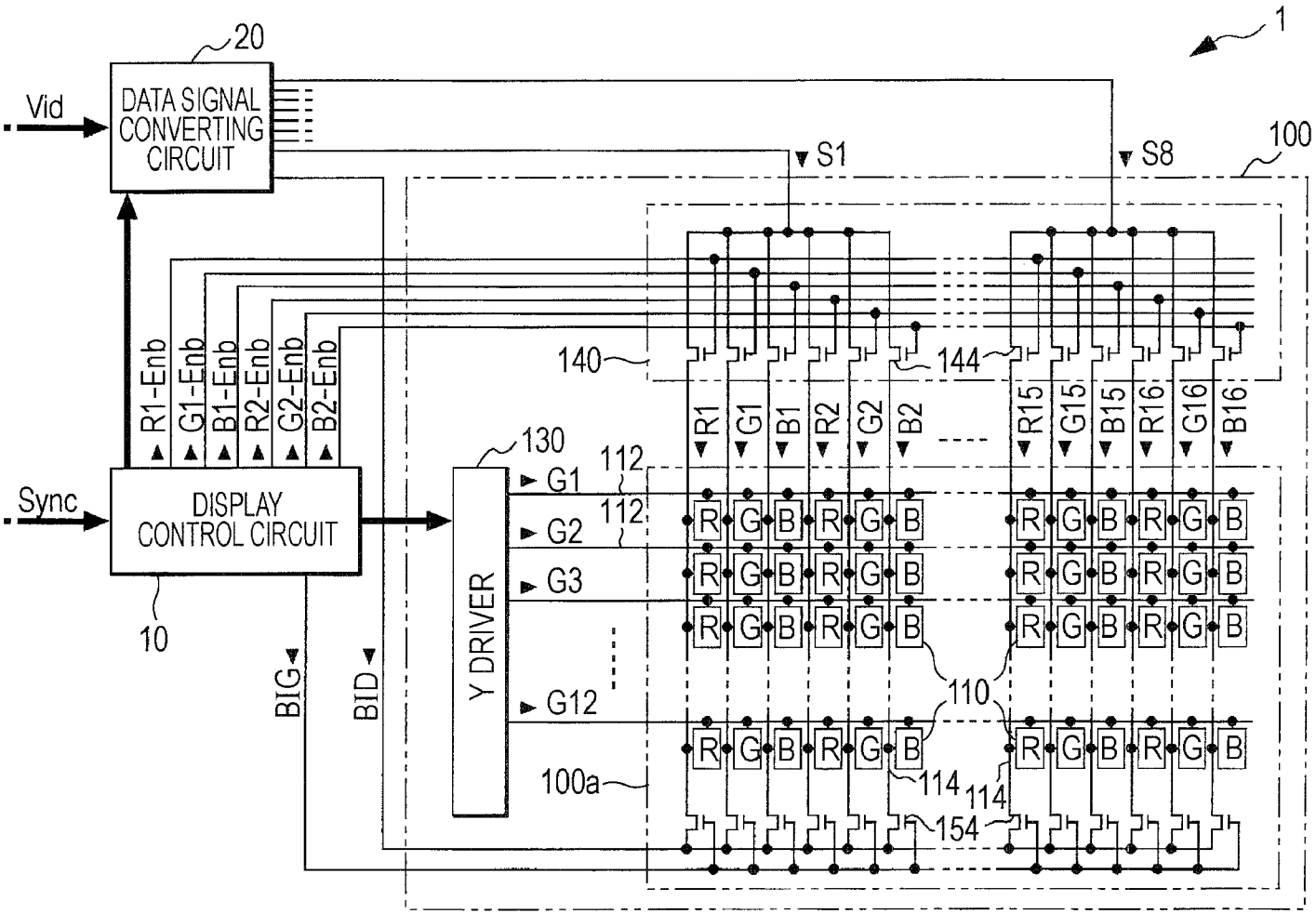
FIG. 9 is a diagram illustrating an electro-optical device according to an application and modification example.

Also, in the above-described embodiments, the configurations were provided in which the data signal making the pixel a black color in the black insertion writing is supplied to the data line 114 through the same pathway as the data signal for display in the image data writing, namely, via the demultiplexer 140 (TFT 144). However, for example, as shown in FIG. 9, a configuration may also be provided in which a TFT 154 is separately provided at the other end of the data line 114, so that the data signal making the pixel a black color in the black insertion writing is supplied to the data line 114 via the TFT 154.

Further, the TFT 154 is of n-channel type, for example. The drain electrode of the TFT 154 is connected to the other end of the data line 114, and the source electrodes of the TFTs 154 are connected in common. Similarly, the gate electrodes of the TFTs 154 are also connected in common.

To the common portion of the source electrodes of the TFTs 154, a data signal BID making the pixel a black color is supplied from the data signal converting circuit 20, and to the common portion of the gate electrodes of the TFTs 154, a control signal BIG is supplied from the display control circuit 10.

Figure 10:
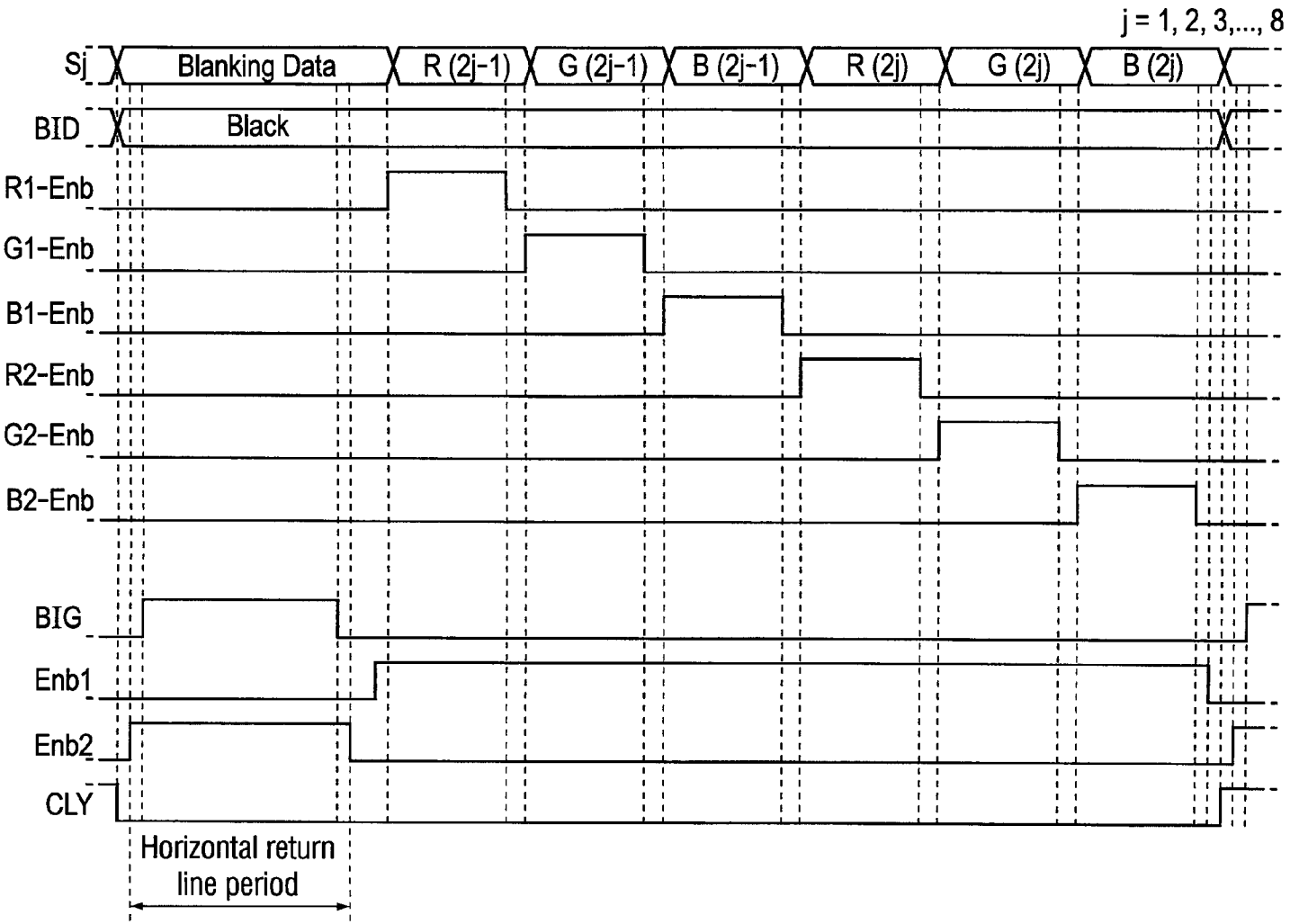
FIG. 10 is a diagram illustrating the horizontal scanning operation of the electro-optical device according to the application and modification example.

Here, as shown in FIG. 10, the control signal BIG becomes a H level when the enable signal Enb2 is in a H level period in the horizontal return line period. When the control signal BIG becomes a H level, all TFTs 154 are turned on, so that the data signal of the voltage (Black) minimizing a transmittance is supplied to all data lines 114. If the i-th row is designated for the black insertion writing, the pixels of the i-th row are changed from the previous voltage according to a gray scale to the voltage minimizing a transmittance, by the black insertion writing, so that black display is obtained.

In the second embodiment, the Y driver 130 performs the vertical scanning in the scanning direction of the 1st row→the 12th row. However, conversely, it may also perform the vertical scanning in the scanning direction of the 12th row→the 1st row. As the configuration in which the vertical scanning direction is inverted in this way, for example, when two stages of the odd number and even number stages shown in FIG. 4 are considered as being one stage, a configuration is considered in which a pathway with the output signal of the (i+1)th stage used as the input signal of the i-th stage is secured and the start pulse DY is inputted to the 12th stage.

Further, in the embodiments, color display is made using three colors of R•G•B as the used primary color. However, four colors or more may also be used, and when black and white display is adopted, the color may not be divided into three colors or more.

The pixel 110 is not limited to a transmission type, but it may also be a reflection type or a semi-reflection and semi-transmission type in which both types are combined.

Example of Electronic Apparatus

Figure 11:
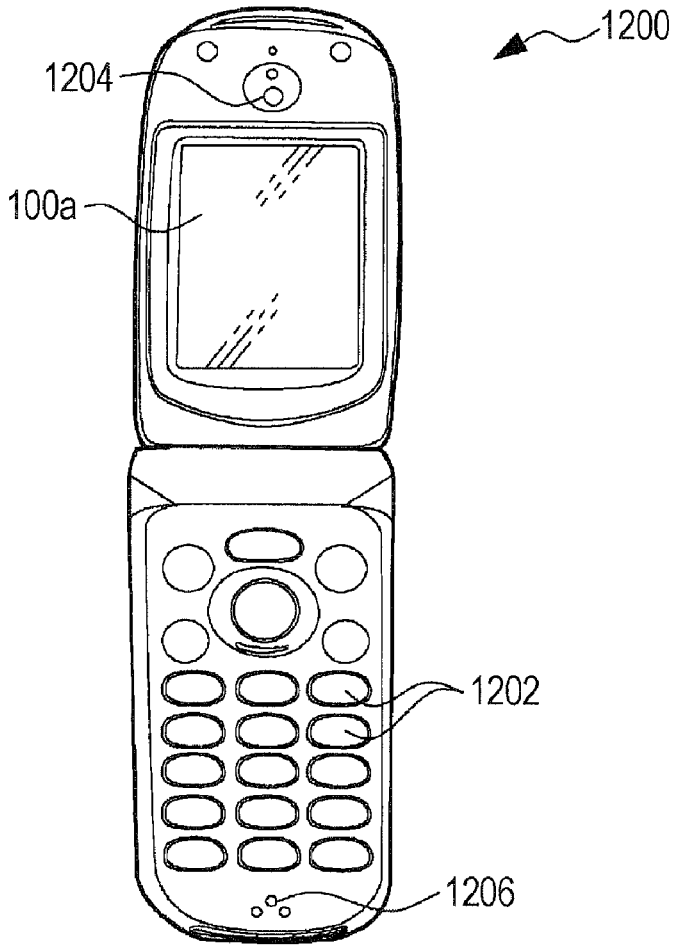
FIG. 11 is a diagram illustrating an example of an electronic apparatus to which the electro-optical devices according to the embodiments and the like are applied.

Next, an electronic apparatus to which the electro-optical device 1 according to the above-described embodiments is applied is explained. FIG. 11 is a view showing the configuration of a portable telephone 1200 using the electro-optical device 1 according to the embodiments.

As shown in the drawing, the portable telephone 1200 has a plurality of operating buttons 1202, an earphone port 1204, a microphone port 1206, and the above-described electro-optical device 1. Here, the component elements other than the portion corresponding to the display region 100*a* in the electro-optical device do not appear as the appearance of the portable telephone 1200 shown in FIG. 11.

As the electronic apparatus to which the electro-optical device 1 is applied, besides the portable telephone shown in FIG. 11, a digital still camera, a notebook type personal computer, a liquid crystal television, a viewfinder type (or monitor direct-view type) videotape recorder, a car navigation apparatus, a pager, an electronic book, an electronic calculator, a word processor, a work station, a television phone, a POS terminal, a photo-storage viewer, an apparatus provided with a touch panel, and the like can be given. Further, it is needless to say that the above-described electro-optical device 1 can be applied as the display devices for these various electronic apparatuses.

The entire disclosure of Japanese Patent Application No. 2008-264286, filed Oct. 10, 2008 is expressly incorporated by reference herein.

What is claimed is:

1. An electro-optical device comprising:

pixel respectively provided corresponding to the intersections of a scanning lines and a data line and having gray scale according to a data signal supplied to the data line when the scanning line has been selected;

a scanning line driving circuit which selects the scanning line; and a data line driving circuit which supplies a data signal according to the gray scale of the pixel to the data line when the scanning line has been selected for image data writing, and supplies a data signal making the pixel a black color to the data line when the scanning line is selected for black insertion writing, wherein the scanning line driving circuit includes:

a shift register having the number of stages according to a plurality of scanning lines, where each stage shifts and outputs in sequence a start pulse having a predetermined width in accordance with the period of a clock signal; and logic circuits provided corresponding to the scanning lines and operating to determine the logical product of a signal outputted from the shift register of the stage corresponding to the scanning line and an enable signal supplied differently to every group which a given number of adjacent scanning lines have been grouped together, and then supply it as a scanning signal representing the selection of the scanning line, the enable signal corresponding to the group becomes, in a horizontal scanning period in which the image data writing is carried out for the scanning lines belonging to the group, an active level in a horizontal effective scanning period and an inactive level in a horizontal return line period; and in a horizontal scanning period in which the image data writing is not carried out for the scanning lines belonging to the group, an inactive level in the horizontal effective scanning period and an active level in the horizontal return line period, a data line driving circuit which supplies the data signal according to the gray scale of the pixel to the data line in the horizontal scanning period, and supplies a data signal making the pixel a black color to the data line in the horizontal return line period.

2. The electro-optical device according to claim 1, wherein the data line driving circuit changes and supplies the voltage of the data signal into positive polarity and negative polarity every horizontal scanning period on the basis of a given electric potential, when viewed in one column of pixels sharing the data line.

3. The electro-optical device according to claim 1, wherein a frame period is set to be the odd number times of the period of the clock signal, and the horizontal scanning period is set to be the period of the clock signal.

4. The electro-optical device according to claim 1, wherein the data line driving circuit makes the data signal in the image data writing have the same polarity as the data signal in the black insertion writing before the image data writing.

* * * * *